US005688216A

United States Patent [19]

Mauriello

[11] Patent Number: 5,688,216

[45] Date of Patent: Nov. 18, 1997

[54] WEIGHT CARRIAGE ASSEMBLY

[76] Inventor: Anthony Mauriello, 288 N. Walnut St., Ridgewood, N.J. 07450

[21] Appl. No.: 489,993

[22] Filed: Jun. 12, 1995

[51] Int. Cl.[6] ..... A63B 21/06

[52] U.S. Cl. ..... 482/135; 482/97; 482/101; 482/142; 482/908

[58] Field of Search ..... 482/92–94, 97, 482/98, 101, 104, 133, 134, 135, 136, 137, 138, 139, 908, 142

[56] References Cited

U.S. PATENT DOCUMENTS

| | | | |
|---|---|---|---|
| 4,317,566 | 3/1982 | Uyeda et al. | 482/98 |
| 4,339,125 | 7/1982 | Uyeda et al. | 482/98 |
| 4,357,011 | 11/1982 | Voris | 482/98 |
| 4,456,246 | 6/1984 | Szabo | 482/98 |
| 4,700,944 | 10/1987 | Sterba et al. | 482/98 |
| 4,730,828 | 3/1988 | Lane | 482/98 |
| 4,795,149 | 1/1989 | Pearson | 482/98 |
| 4,915,377 | 4/1990 | Malnke et al. | 482/98 |
| 5,135,453 | 8/1992 | Sollenberger | 482/98 |
| 5,184,992 | 2/1993 | Banks | 482/98 |
| 5,273,506 | 12/1993 | Dawson, Jr. | 482/98 |
| 5,529,558 | 6/1996 | Koenig | 482/98 |

FOREIGN PATENT DOCUMENTS

| | | | |
|---|---|---|---|
| 1444065 | 5/1966 | France | 482/98 |

*Primary Examiner*—Richard J. Apley
*Assistant Examiner*—Victor K. Hwang
*Attorney, Agent, or Firm*—Friscia & Nussbaum

[57] ABSTRACT

A weight lifting apparatus is provided which includes a vertical guide rail supported by a base. A carriage assembly rides the guide rail. A handle is interconnected with the carriage and may be adjusted to extend at a plurality of angles therefrom. A weight bearing member is provided for receiving and supporting free weights. The weight bearing member is supported by the carriage and may be interconnected with the handle to permit a user to perform a variety of weight lifting exercises. A horizontal guide rail is also provided which has a carriage assembly for riding the guide rail. The carriage assembly supports an adjustable seat for supporting a user for movement along the horizontal guide rail. The horizontal guide rail can be used in connection with the vertical guide rail, in independent operation, or with conventional weight lifting apparatus to permit a user to perform rowing or other exercises.

13 Claims, 6 Drawing Sheets

WEIGHT CARRIAGE ASSEMBLY

BACKGROUND OF THE INVENTION

1. Field of the Invention

This invention generally relates to an exercise apparatus, and more specifically to a weight lifting apparatus having a carriage assembly that rides a single rail and supports weights.

2. Related Art

Weight lifting has become a very popular way of exercising. Today, many people frequent gyms or health clubs to participate in a variety of exercise activities including weight lifting. Not only can weight lifting increase strength, muscle tone, and burn calories, it can also be an important component in physical rehabilitation programs. Accordingly, a great effort has been made in the past to develop weight lifting equipment for use at home, in gyms, in health clubs and in physical therapy facilities.

Despite the creation of numerous apparatus for use in weight lifting, conventional barbells which support free weights are still widely used by people at home as well as in gyms and health clubs, as such free weights afford advantages over machines, including weight adjustability, constant resistance over an entire range of motion, and transportability. Many machines in the past have tried to emulate the advantages of free weights, though most of these attempts have been unsuccessful in varying degrees. Many of these machines employ stacks of weights attached to handles via cables and pulleys. Other machines have been used to supply elastic resistance and pneumatic resistance to the user. Many of these machines require a radial motion as the handles must be pivoted about an attachment point. Examples of such of previous efforts at weight lifting machines include:

Potts, U.S. Pat. Nos. RE 34,212 and 4,846,458, which disclose an upper body exercise apparatus for assisting with chin-up and dip exercises. The apparatus includes a base for standing on. The base raises and lowers the user with respect to chin-up handles and dip handles. A pneumatic cylinder is pivotally connected between a base and a beam, which beam is pivotally connected to the platform. The upward force of the cylinder is imparted to the beam and, in turn, to the platform. The pneumatic cylinder is interconnected to an accumulator and an air compression motor. The pneumatic cylinder includes a bleed valve to decrease the pressure in the cylinder. The cylinder, accumulator and air compression motor are regulated by computer control via a monitor console. The upward force exerted on the platform is tuned in that the torque increases as the platform rises and torque on the beam increases as the platform rises and the pressure in the cylinder decreases as the value increases when the cylinder is extended.

Marcyan, U.S. Pat. No. 3,627,315, discloses a leg exercising apparatus having a vertical frame, a stack of weights, a cable and pulley assembly, a pair of reciprocative slidable skates each for supporting a foot of a person, and tracks upon which the skates glide. The weights, via the cable and pulley system, provide resistance to the skates.

Marcyan, U.S. Pat. No. 3,635,472, discloses an exercise device comprising of a vertical frame, a weight stack, a pulley and cable system, vertical tracks, a carriage for sliding vertically along the vertical tracks and a lifting arm removably connected to the carriage and positioned along a plurality of discrete vertically spaced connection points along the carriage.

Mahnke et al., U.S. Pat. No. 4,199,139, discloses an exercising apparatus comprising a vertical frame, a stack of weights, a cable and pulley system and a back support which rides an inclined track.

Keiser, U.S. Pat. No. 4,227,689, discloses a pneumatic exercise device for exercising movement along a curved path of travel, primarily for exercising legs. The device includes a frame, a support seat mounted to the frame, and an arm rotationally mounted to the frame having a cushioned roller at the end thereof. The arm is attached by a linkage to a lever arm which bears against a pneumatic cylinder.

Keiser, U.S. Pat. No. 4,257,593, discloses a pneumatic exercising device having a source of compressed gas, a reservoir, a pair of pneumatic cylinders and grasping means interconnected therewith. The pneumatic cylinders are interconnected between a platform and exercising members which support the grasping means. Each pneumatic cylinder has a pressure gauge mounted thereon and an air pressure regulator is mounted on the reservoir which is adjusted via a dial to regulate the pressure from the storage reservoir. Conduits lead from the compressor to normally closed valves, from which additional conduits lead to the reservoir and then to the pneumatic cylinders. The volume of space within the reservoir tanks can be adjusted by means of a lever arm to adjust the pressure between first and second chambers of the pressure tanks. A sight gauge is provided on the reservoir assemblies for indicating the percentage increase of resistance force from the start to the completion of an exercising stroke. The sight indicator corresponds to the level of a fluid in the first chamber of reservoir assembly.

Szabo, U.S. Pat. No. 4,346,888, discloses a weight lifting apparatus comprising a vertical frame, a stack of weights and a cable pulley system leading to a carriage supporting a handle. The pulleys are positioned to permit numerous exercises to be performed on this apparatus. The handle is adjustably positioned vertically with respect to the carriage.

Lambert Jr. et al., U.S. Pat. No. 4,349,192, discloses a counterbalance weight system for an exercise machine having a vertical framework. A handle is attached to a carriage which rides up and down the framework The handle can be positioned at any desired angle but once fixed at such angle in the factory, it cannot thereafter be altered.

Wilmarth, U.S. Pat. No. 4,397,462, discloses a pneumatic exercising device having a lever arm, a pneumatic cylinder, a reservoir and a pump. The lever arm is mounted on a fulcrum and extends beyond the fulcrum to directly contact the pneumatic cylinder. The reservoir is many times larger than the displacement of the pneumatic cylinder so that the pressure in the reservoir and the pneumatic cylinder remains essentially constant over the stroke of the cylinder.

King, U.S. Pat. No. 4,728,101, discloses a pneumatic exercising device comprising a two way air cylinder, air compressor and a storage tank. The device includes a main support member, and the pneumatic cylinder is fixed to the main support member at an upper end thereof. Gripping bar assemblies are slidably affixed to the main support member and interconnected with the pneumatic cylinder.

Barrett, U.S. Pat. No. 4,799,672, discloses a spotter safety device comprising two vertical support members each having spotting arms extending therefrom. Each spotting arm is coupled with a cylinder.

Askonen, U.S. Pat. No. 4,826,154, discloses an exercise device comprising a stack of weights, a cable, a system of pulleys, and a carriage having a handle. The carriage includes guide wheels for moving along a vertical frame structure.

Lighter, U.S. Pat. No. 4,911,436, discloses a pneumatic exercise device having an upstanding frame member that supports a pivotal lever arm having air cylinders positioned thereabove and attached directly thereto. The pivotal lever and the cylinders are attached to a sleeve which may be movably adjusted along the center frame. An accessory cable may be attached to the lever arm and extended around the device via pulleys so that one may exercise his or her legs.

Brentham, U.S. Pat. No. 5,114,389, discloses a pneumatic stair climber device including a pair of pedal arms pivotally secured to a frame and interconnected with a double-acting hydraulic cylinder.

Jain et al., U.S. Pat. No. 5,151,071, discloses a lifting device comprising an arm positioned on the vertical column. Various attachments and handles can be secured to the end of the arm. The arm includes a force sensor that measures forces applied to the handles. The device also includes static and dynamic modes. A resistance mechanism is used to resist the lifting force in the dynamic mode. The resistance mechanism comprises a flexible cable attached through a system of pulleys interconnected with a weight stack.

Kelsey, et al., U.S. Pat. No. 5,273,502, discloses a therapeutic apparatus comprising a support frame, an automatic winch attached thereto, and a cable interconnected between the winch and a harness via a spring. A user is positioned within the harness and the weight is unloaded an amount determined by a load cell. The winch automatically outlays and intakes the ropes so that in connection with the spring, a constant load on the user is maintained.

None of these previous efforts disclose all of the benefits and advantages of the present invention, nor do these previous patents teach or suggest all of the elements of the present invention.

OBJECTS AND SUMMARY OF THE INVENTION

It is a primary object of the present invention to provide a weight lifting apparatus having a single vertical guide rail.

It is another object of the present invention to provide a weight lifting apparatus having a carriage assembly for riding a single vertical guide rail.

It is even another object of the present invention to provide a weight lifting apparatus having a carriage assembly including rollers for smoothly rolling along the guide rail.

It is an additional object of the invention to provide a weight lifting apparatus which uses free weight plates.

It is a further object of the present invention to provide a weight lifting apparatus having a guide rail, a carriage assembly, a weight bearing member, and a handle, wherein the weight bearing member is positioned forward on the carriage toward the handle to reduce binding of the carriage assembly with respect to the guide rail.

It is another object of the present invention to provide a weight lifting apparatus having a carriage with an adjustable handle.

It is even another object of the present invention to provide a weight lifting apparatus having an adjustable handle, which handle can be adjusted through a plurality of angles with respect to the carriage and the guide rail.

It is still another object of the present invention to provide a weight lifting apparatus which has an adjustable handle which can be easily adjusted even while bearing weight.

It is yet another object of the present invention to provide a weight lifting apparatus having an adjustable handle, which handle is pivotally adjustable about the weight bearing member.

It is even another object of the present invention to provide a weight lifting apparatus having a handle that may be moved linearly during the lifting of weights.

It is still yet another object of the present invention to provide a weight lifting apparatus that can carry a large amount of weight.

It is a further object of the present invention to provide a weight lifting apparatus that can be used for performing military press exercises.

It is even a further object of the present invention to provide a weight lifting apparatus that can be used for performing bench press exercises.

It is yet a further object of the present invention to provide a weight lifting apparatus that can be easily adapted for performing other exercises.

It is even a further object of the present invention to provide a weight lifting apparatus which can be adapted for use with weight stacks and/or pneumatic cylinders.

It is another object of the present invention to provide a weight lifting apparatus which can be used for leg press and squat exercises.

It is an additional object of the present invention to provide a weight lifting apparatus having a guide rail which can be angled from vertical with respect to the ground to facilitate leg presses and/or hack squats.

It is even an additional object of the present invention to provide a weight lifting apparatus having an attachable back pad to facilitate squatting exercises.

It is still a further object of the present invention to provide a weight lifting apparatus that can be used in physical therapy applications.

It is an even further object of the present invention to provide a weight lifting apparatus that can be used in physical therapy applications to measure the height one can lift a weight.

It is also an object of the present invention to provide a weight lifting apparatus that is safe to use.

It is another object of the present invention to provide a weight lifting apparatus that is portable.

It is another object of the present invention to provide a weight lifting apparatus that taken up a minimal amount of space.

It is even another object of the present invention to provide a weight lifting apparatus that can be mounted to a wall.

It is still another object of the present invention to provide a weight lifting apparatus that includes a horizontal guide rail for guiding a carriage having a seat thereon.

It is yet another object of the present invention to provide a weight lifting apparatus that can be used for performing rowing exercises.

It is still even another object of the present invention to provide a weight lifting apparatus which eliminates the hazard associated with free weights of pinning the user under weights.

It is even an additional object of the present invention to provide a weight lifting apparatus having a guide rail with a dead stop welded to the guide rail to reduce the chance of pinning the user under weights.

It is an additional object of the present to provide a weight lifting apparatus which can be manufactured for a relatively low cost.

These and other objects are achieved by the weight lifting apparatus of the present invention which includes a vertical guide rail supported by a base. A carriage assembly rides the guide rail. A handle is interconnected with the carriage and may be adjusted to extend at a plurality of angles therefrom. A weight bearing member is provided for receiving and supporting free weights. The weight bearing member is supported by the carriage and may be interconnected with the handle to permit a user to perform a variety of weight lifting exercises.

The present invention is also directed to a horizontal guide rail having a carriage assembly for riding the guide rail. The Carriage assembly supports an adjustable seat for supporting a user for movement along the horizontal guide rail. The horizontal guide rail can be used in connection with the vertical guide rail, in independent operation, or with conventional weight lifting apparatus to permit a user to perform rowing or other exercises.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
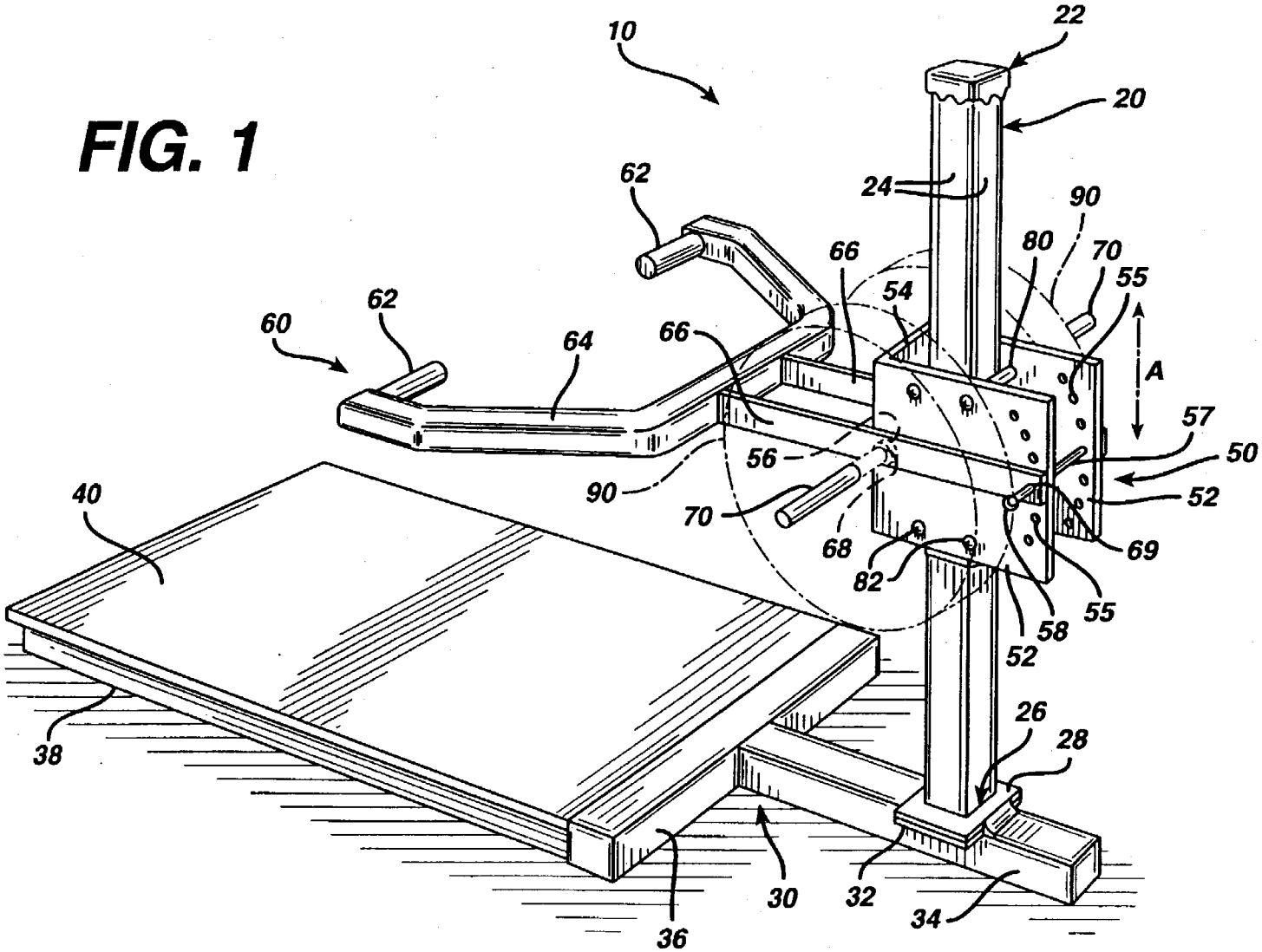
FIG. 1 is a perspective view of the weight lifting apparatus of the present invention showing the vertical guide rail, the carriage assembly, the handle, the base, and the weight bearing member supporting free weights (shown in phantom) thereon.

Referring to FIGS. 1–5, the exercise apparatus of the present invention, generally indicated at 10, comprises a number of primary components, including: a guide rail generally indicated at 20, a base generally indicated at 30, a carriage assembly generally indicated at 50, and handle bars generally indicated at 60.

The guide rail 20 is generally of an elongated box-like construction having an upper end or top 22, a lower end or bottom 26, and sides 24. The guide rail 20 stands on its bottom 26 and extends vertically upward therefrom to its top 22. Importantly, the guide rail 20 can embody numerous other configurations such as a column formed by two opposing sheets of material, i.e. two sides spaced apart, a cylindrical column, parallel cylindrical columns, or any other desired configuration known in the art, as long as it can guide a carriage assembly therealong as will hereinafter be described. The guide rail 20 may include a stop means either fixedly or adjustably positioned thereon to prevent the carriage assembly from traveling beyond a predetermined point to prevent the danger of a user being pinned under weights. The stop means could simply be a block welded to the guide rail 20, or a more complex adjustable mechanism.

While it is generally desirable for the guide rail 20 to maintain a vertical position for many exercises, it may be desirable, and is indeed within the scope of the present invention, to position the guide rail at an angle to vertical to facilitate the performance of other exercises such as leg presses or hack squats as will hereinafter be described. Accordingly, it may be desirable to provide means to vary the angle of the guide rail 20. Finally, it should be noted that the guide rail 20 shown in the figures is of a unitary construction, but it may be desirable to provide means for folding the guide rail or for extending or reducing the height thereof, and these modifications are also considered to be within the scope of the present invention.

Attached to the bottom 26 of the guide rail 20 is a bottom plate 28 which may be welded to the guide rail 20 or otherwise attached thereto in any manner known in the art. The bottom plate 28 connects the guide rail 20 to the base 30. As shown, the base 30 includes base support member 34 which is of a generally elongated box-like construction. Attachment plate 32 is attached to the base support member 34 by welding or by any other means known in the art. The bottom plate 28 of the guide rail 20 is interconnected with the attachment plate 32 preferably by bolts to allow for the detachment thereof to facilitate shipping, storage and portability of the apparatus, but alternatively may be connected therewith by welding or by any other means known in the art.

The base support member 34 provides forward/rearward support to the guide rail 20. The base support member 34 is interconnected with cross member 36, by welding or any other desired means. The cross member 36 is also of an elongated box-like construction similar to the base support member 34. The cross member 36 provides side-to-side support to the guide rail 20.

Importantly, the base 30 may not necessarily include base support member 34 and cross member 36, but may be of a plate construction or any other desired configuration to support the guide rail 20. It should even be noted that one embodiment of the present invention (not shown), the guide rail 20 is attached at the top 22 thereof to a wall by means an arm to support the guide rail 20. In this embodiment, the bottom 26 of the guide rail 20 may merely rest on the ground or it may be interconnected with a minimal support means. Likewise, other methods of supporting the guide rail 20 are considered within the scope of the present invention.

Figure 2:
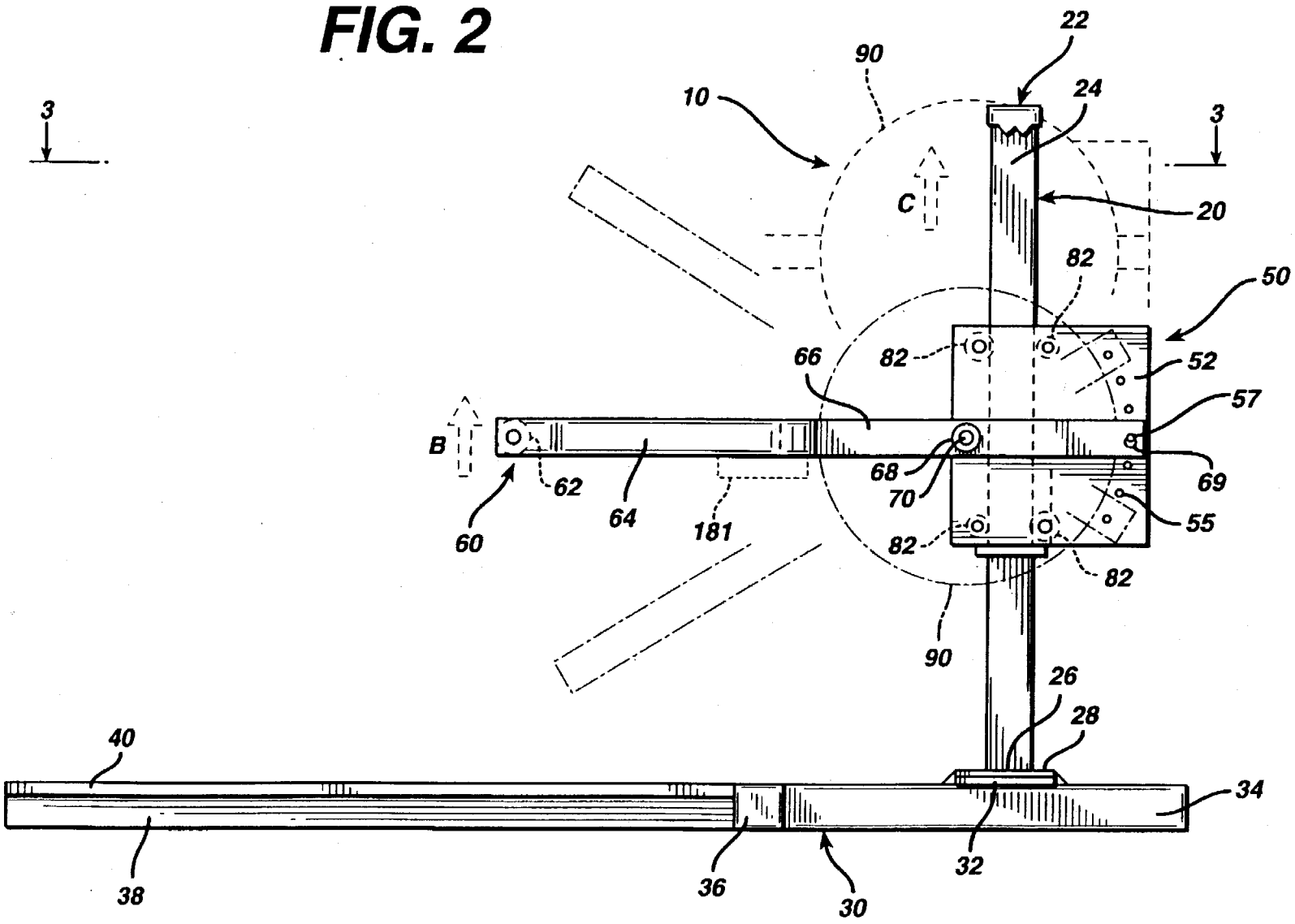
FIG. 2 is a side plan view of the apparatus shown in FIG. 1 showing the adjustability of the handle and the movement of the carriage with respect to the guide rail.
Figure 3:
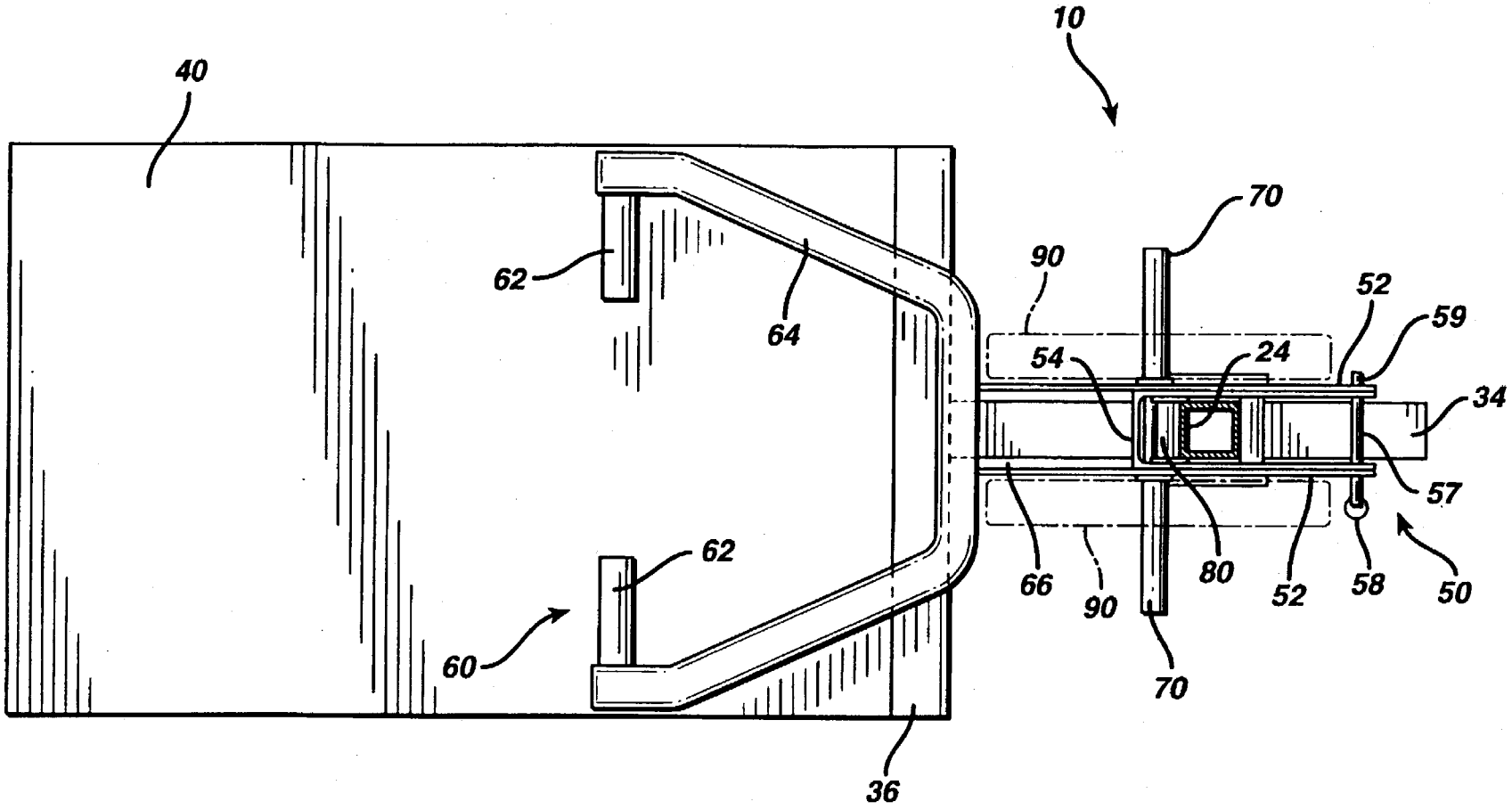
FIG. 3 is a top partially sectional view of the apparatus shown in FIG. 1 taken along the line 3—3 in FIG. 2.
Figure 4:
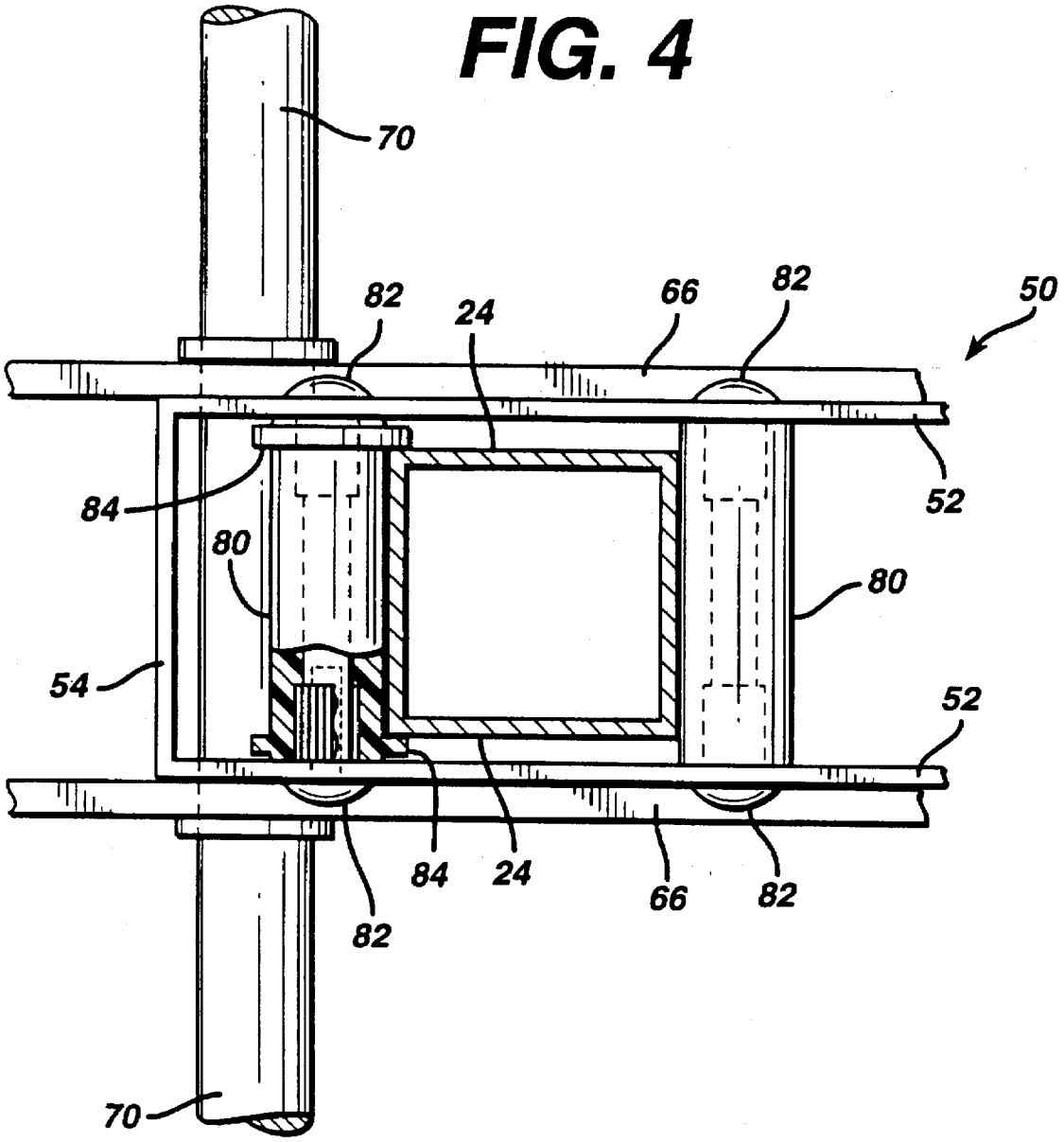
FIG. 4 is a top partially sectional view of the apparatus shown in FIG. 1 showing the guide rail, the carriage assembly, the weight bearing member and the rollers for supporting the carriage on the guide rail.
Figure 5:
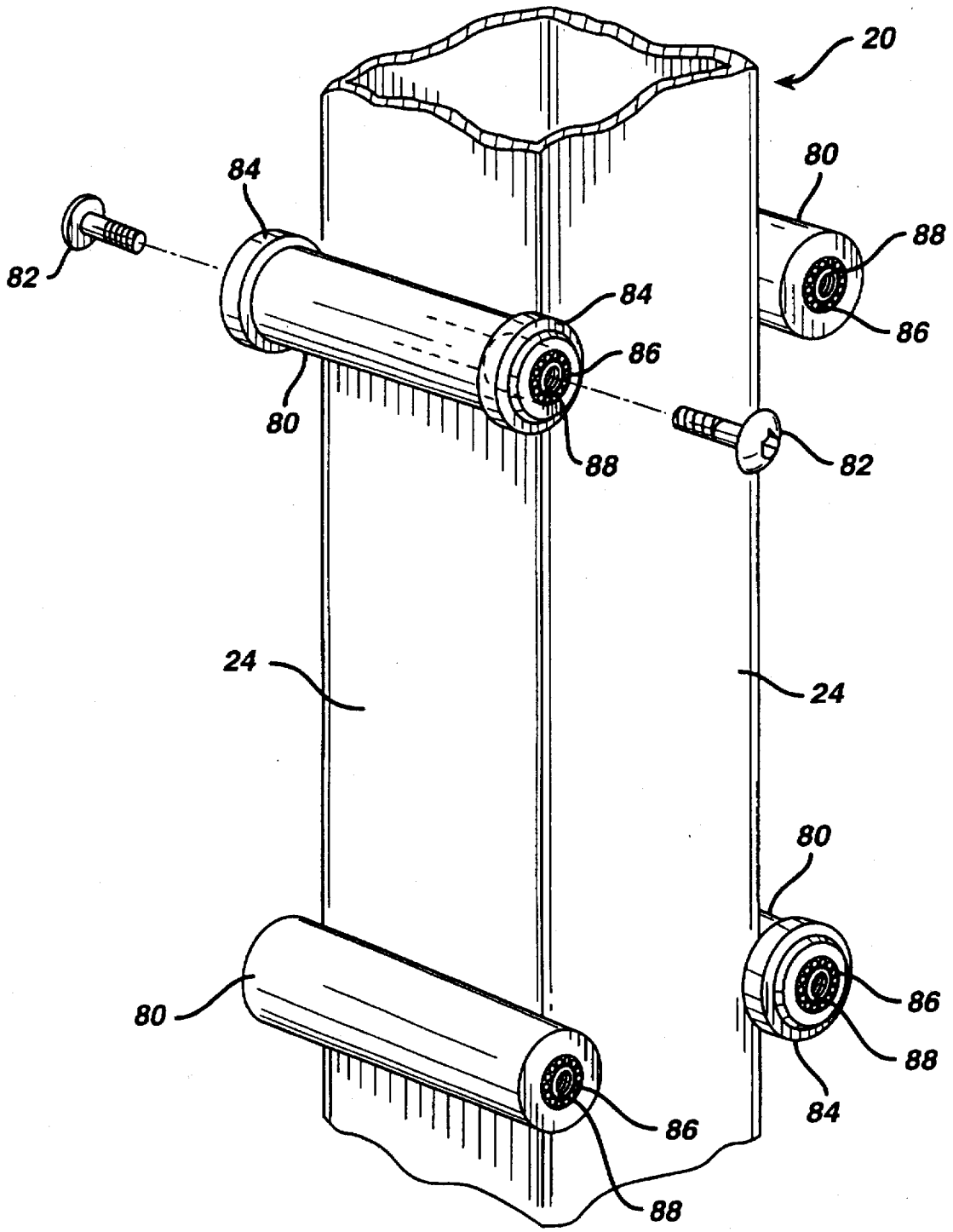
FIG. 5 is a partially exploded perspective view of the guide rail and the rollers of the apparatus shown in FIG. 1.

As shown in FIGS. 1, 2 and 3, a platform 40 may be interconnected with the base 30. The platform 40 defines the exercise area of the exercise apparatus 10, may be used to support a bench (not shown) or other auxiliary equipment and provides additional support for the guide rail 20. The platform 40 may be fabricated from any desired material such as wood or metal, and may be of a generally rectangular shape. The platform 40 may be supported by platform support members 38 which may be interconnected with the cross member 36. The platform 40 could be attached to the cross member 36, or could only be attached to the platform support members 38, or could merely rest on the platform support members 38. Importantly, the platform could be constructed in any manner known in the art, or alternatively, the exercise apparatus 10 of the present invention could be used entirely without a platform.

As shown in FIGS. 1–4, a carriage assembly 50 is provided to ride along the guide rail 20, in the directions indicated by arrow A in FIG. 1 and arrows B and C in FIG.

2. The carriage assembly 50 is of a generally U-shaped configuration, having opposing side walls or plates 52 and a connecting plate 54 connecting the side plates 52 together along one edge thereof. The carriage assembly 50 may be formed of a unitary construction or by separate members joined together. Importantly, the carriage assembly 50 is sized to receive the guide rail 20 between the opposing side plates 52. However, it should be noted that if the guide rail comprises facing strip members to form a column, it may be desirable for the side plates 52 to fit within such facing strip members. Also, the carriage assembly 50 could be configured to wrap entirely about the guide rail 20. Likewise, other means of interconnecting a carriage with a column known in the art are considered within the scope of the invention.

The side plates 52 of the carriage assembly 50 may include a plurality of corresponding adjustment apertures 55 for adjusting the angle of the handle 60 as will hereinafter be described. The side plates 52 may also include corresponding weight bar apertures 56 for receiving a weight support bar 70 therethrough as will also hereinafter be described.

The side plates 52 of the carriage assembly 50 also include apertures for supporting rollers 80 that facilitate movement of the carriage assembly 50 along the guide rail 20. In a preferred embodiment of the invention, the carriage assembly 50 supports four rollers, two of the rollers 80 positioned on each side of the guide rail 20, one each at an upper and lower end of the carriage assembly 50, to provide optimal support for the carriage assembly 50 en the guide rail 20. AS shown in detail in FIGS. 4 and 5, the rollers 80 include roller bolts 82 for extending through the side plates 52 and securing the rollers 80 therebetween, while allowing the rollers to rotate as the rollers 80 are moved along the guide rail 20. The rollers 80 may be manufactured of a plastic material by extruding solid cylindrical pieces and then cutting them to size. Thereafter, a central bore is bored through each roller and the ends thereof are countersunk to a diameter larger than the bore.

A core 88, preferably a metal cylinder, is inserted through the bore and bearings 86 are placed in the countersunk ends between the core 88 and a metal liner positioned inside of the countersunk ends. Preferably, needle bearings 86 are employed to withstand the large forces created during exercising. Importantly, it has been discovered that it is desirable to machine some of the rollers 80 to create flanges 84 at the ends thereof. These rollers are positioned at top front and the lower rear of the carriage assembly 50 to assist in supporting the carriage assembly 50 on the guide rail 20, as it is these rollers which resist the moment created during weight lifting exercises. Also, it should be noted that the lower front and upper rear rollers, which are not weight bearing, may be of a simplified construction. Also, washers (not shown) may be positioned between the side plates 52 of the carriage assembly 50 and the rollers 80. Again, it should be noted that rollers of other configurations, as are known in the art, may be used in accordance with the present invention. For example, the rollers could be V-shaped wheels with grooves for coacting with a column comprising opposing parallel strips. Additionally, other systems known in that art, such as sliders, or linear bearings, may be employed and are considered to be within the scope of the present invention.

Referring back to FIGS. 1–3, it can be seen that the carriage assembly supports a handle 60 for a user to actuate the exercise apparatus 10. The handle 60 includes hand grips 62 and handle bar 64 constructed in accordance with what is known in the art. Importantly, the handle 60 can be removed and replaced with handles of other configurations known in the art, for example, a T-shaped handle. Also, the hand grips 62 may be removable from the handle bar 64 and replaceable with hand grips of various other configurations known in the art. Ears with apertures may be provided on the handle bar 64 for receiving a cross bar extending therebetween.

The handle 60 is interconnected with the carriage assembly 50 by means of handle attachment plates 66 which may be parallel metal strips extending from the handle bar 64. The handle attachment plates 66 are spaced apart to accept the carriage assembly 50 therebetween. The handle attachment plates 66 interconnect with the carriage assembly 50 by means of apertures in the handle attachment plates 66 which correspond to apertures in the side plates 52, namely weight bar apertures 68 which correspond to weight bar apertures 56 in the side plates 52, and adjustment apertures 69 which correspond to adjustment apertures 55 in the side plates 52. Alternatively, the handle 60 could be attached to the carriage assembly 50 in any other suitable manner, including by being pinned or welded to the carriage, or the handle could merely be a bar attached to a line which is interconnected with the carriage assembly through pulleys as is known in the art.

A weight support bar 70 extends through the weight bar apertures 68 in the handle attachment plates 66 and through the weight bar apertures 56 in the side plates 52 of the carriage assembly 50. Thus, the carriage assembly 50 supports the weight bar 70 and the weight bar 70 pivotally secures the handle 60 to the carriage assembly 50. The weight bar 70 is of a conventional thickness to receive and support free weights thereon. It is sized to extend away on both sides from the carriage assembly 50 and the handle attachment plates 66 sufficiently to permit a suitable amount of free weights to be positioned thereon.

Importantly, the weight bar could be positioned anywhere on the carriage, though it is desirable to position the weight bar towards the front center of the carriage to prevent binding. The weight bar could be attached to the carriage as described, or could even be welded thereto, or could merely rest on the carriage, preferably on grooves formed for receiving the weight bar. Further the weight support does not necessarily have to be a bar, but could merely be ears welded to the carriage, or any other configuration to support weight on the carriage. In another embodiment of the invention, the weight support bar could be carried by the handle, or it could be carried by a second carriage assembly resting above or hung below the primary carriage assembly. Additionally, it is within the scope of the present invention to provide a second carriage assembly for supporting weights on a second column. In such an embodiment, the second and primary carriage assemblies could be interconnected by means of lines and pulleys as is known in the art.

An adjustment pin 57 is employed to extend through the adjustment apertures 69 in the handle attachment plates 66 and through the adjustment apertures 55 in the side plates 52 to secure the handle attachment plates 66 to the carriage assembly 50. As is known in the art, the adjustment pin 57 may include a ring 58 at one end thereof for facilitating manipulation of the adjustment pin 57, and a detente, or spring loaded mechanism 59, at the other end thereof to retain the adjustment pin 57 in position and to prevent the adjustment pin 57 from unwanted disengagement. The detente 59 extends radially outward of the adjustment pin. The adjustment pin 57 is disengaged by pulling on the ring with sufficient force to contact the detente 59 against the attachment plate 66 to force the detente to move radially inward against its normally outward bias to move the detente 59 past the attachment plate 66 to allow for the removal of the adjustment pin 57 from engagement. The adjustment pin 57 is similarly engaged by forcing the detente 59 past the handle attachment plates 66 and the side plates 52.

As shown in FIG. 2, the handle 60 can adjusted to a plurality of angles with respect to the carriage assembly 50, and accordingly, with respect to the guide rail 20, to accommodate the desires of the user. In order to adjust the angle of the handle 60, the adjustment pin 57 is withdrawn from engagement with the attachment plates 66 and the carriage assembly 50, and the handle 60 is then free to rotate about the weight support bar 70. The handle 60 is then rotated about the weight support bar 70 to a desired angle, and the adjustment pin 57 is inserted through the attachment plates 66 and the carriage assembly 50 to retain the handle 60 at the desired angle. Accordingly, the angle of the handle 60 can be easily adjusted while the weight support bar 70 supports free weights thereon.

In operation, the user adjusts the angle of the handle 60 with respect to the exercise apparatus 10 to a desired angle. Either before or after adjusting the angle of the handle 60, the user can load free weights onto the weight support bar 70 as desired. Next, the user grasps the hand grips 62 and performs weight lifting exercises. At any time, the user can add or remove free weights to the weight support bar, and or can further adjust the angle of the handle 60. In order to perform a variety of weight lifting exercises, the user can position a bench under the handle 60 to perform bench presses, or can use other auxiliary equipment to perform a variety of other exercises. For example, a back pad 181 could be attached to the handle bar 64 to allow a user to position his or her back and/or shoulders below the handle bar 64 to perform squat lifting exercises. Alternatively, in therapy applications, a height measuring device could be used to measure the height one could lift the handle. Other modifications and additions are also considered within the scope of the present invention.

Figure 6:
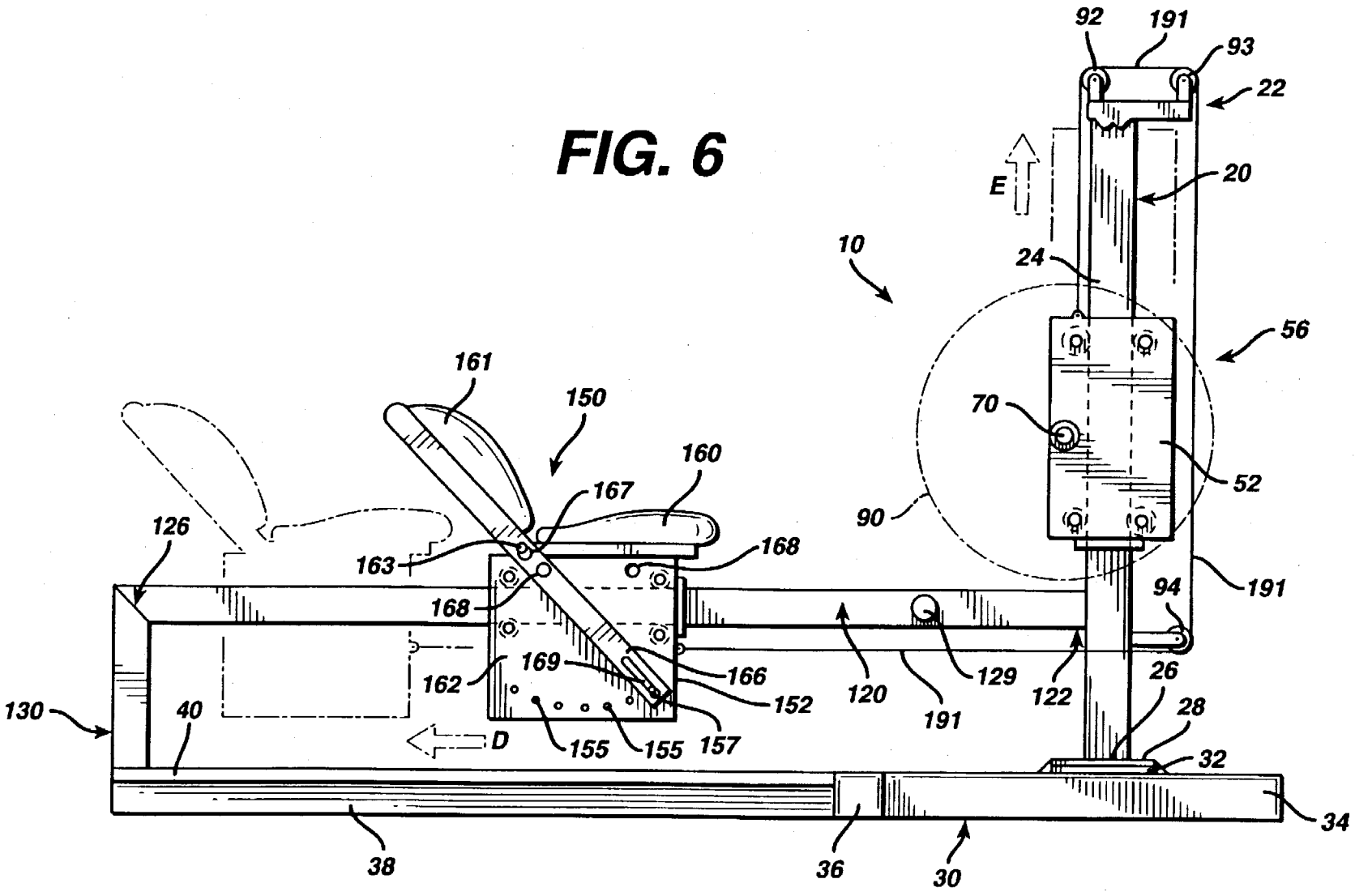
FIG. 6 is a side plan view of another embodiment of the apparatus shown in FIG. 1 having a horizontal guide rail with a carriage assembly for riding therealong and an adjustable seat for supporting a user.

Referring now to FIG. 6, another embodiment of the present invention is shown. This embodiment of the invention comprises a generally horizontal guide rail 120 having a forward end 122, a back end 126, and foot rests 129. The horizontal guide rail 120 may be constructed and configured as the vertical guide rail 20 hereinbefore described. The horizontal guide rail 120 may be supported off the ground by attachment of the back end 126 to a base member 130 extending up from the ground. The attachment and construction of the base member 130 can be made in accordance with the considerations that apply to the base 30 of the vertical guide rail 20 and with what is known in the art, though it may be desirable to allow for the horizontal guide rail 120 to be angled from horizontal with respect to the ground. The base member 130 may even be interconnected with the base 30 of the vertical guide column 20 when the horizontal guide rail 120 is used in connection therewith. The forward end 122 of the horizontal guide rail 120 may be supported by a base member or it may be interconnected with another exercise device, such as the vertical guide rail 20. Also, it should be noted that other support means may be provided for the horizontal guide rail intermediate of the forward 122 and back 126 ends to facilitate angling the horizontal guide rail 120 with respect to the ground.

A seat assembly 150 is provided to ride the horizontal guide rail 130. The seat assembly 150 is constructed similar to the carriage assembly 50 that rides the vertical column 20 except that it includes a seat 160 and a back rest 161. The seat assembly 150 is essentially the same apparatus as the carriage assembly 50 of the previous embodiment. The seat assembly includes a carriage having side plates 162 and a connecting plate like the carriage assembly 50 for the vertical column 20. Additionally, the seat assembly 150 is configured in accordance with the configuration of the carriage assembly 50. The back rest 161, even, is nothing more than a modification of the handle 60 with a back rest pad attached thereto, and a means for interconnecting with a seat 160, which may be nothing more than apertures 167 to receive projections 163 extending from the seat 160. The seat attachment plates 166 are also configured in accordance with the requirements of the attachment plates 66 of the handle 60, though in the embodiment shown in FIG. 6, the adjustment aperture has been replaced with an adjustment slot 169, which allows the seat back 161 to be angled while pivoting about either of two handle bar apertures 168 formed in the carriage. The handle bar apertures 168 in the attachment plates 166 and the side plates 162 correspond to the weight support apertures 56 and 68 in the carriage and the handle respectively in the previous embodiment. Likewise, a handle bar may extend through the handle bar apertures 168 to be gripped by a user to hold his or her self onto the seat, which corresponds to the weight support bar 70 in the previous embodiment. The adjustment slot 169 corresponds to adjustment apertures 155 in the carriage to permit the seat back 161 to be positioned at a plurality of angles, independent of whether the seat is facing forward or rearward. Art adjustment pin 157 is used to secure the position of the seat back 161 as set forth with respect to the carriage assembly 50 for the vertical guide rail 20.

The seat assembly 150 rides the horizontal guide rail 120 in accordance with the considerations of the way the carriage assembly 50 rides the vertical guide rail 20 in the previous embodiment, i.e. on rollers or in any other desired manner.

The horizontal guide rail 120 and the seat assembly 150 can be used in connection with the vertical guide column of the previous embodiment, or with other available equipment to permit a user to perform a variety of exercises. For example, horizontal guide rail can be interconnected with the vertical column 20 and the seat assembly 150 can be adjusted as shown in FIG. 6 to permit a user to perform rowing exercises. The carriage assembly 50, supporting weight bar 70 which carries free weights 90 thereon may be interconnected with the seat assembly 150 by means of a line 191 that extends up from the carriage assembly 50, over pulleys 92 and 93 at the top 22 of the vertical guide rail 20, and then runs down the vertical guide rail 20 to pulley 94, and then runs along the horizontal guide rail 120 to the seat assembly 150. The user sits on seat 160, positions his or her feet on foot rests 129, and can push the seat assembly 150 rearward in the direction of arrow D along the horizontal guide rail 120 to lift the carriage assembly 50 and the weights 90 up the vertical guide rail 20 in the direction of arrow E to exercise his or her legs in the context of a rowing exercise. Additionally, leg press exercises could be performed by moving the seat assembly 150 forward on the horizontal guide rail 120, raising the forward end of the horizontal guide rail 120 to put the horizontal guide rail 120 and the seat assembly 150 on an incline, and interconnecting foot rests in the carriage assembly 50. Such a leg press exercises could also be facilitated by angling the top 22 of the vertical guide rail 20 away from the horizontal guide rail 120.

Additional exercises can be performed by manipulating the seat assembly 150. For example, the seat back 161 can be pivoted to lie flat in the same plane as the seat 160 to form a bench which one could use for performing bench presses. Also, the seat can be turned around to face rearward to permit a user to perform inclined bench presses.

Additionally, the horizontal guide rail 120 could be inclined to further the effect. Additionally, it is within the scope of the invention to provide a seat back 161 on both sides of the attachment plates 166 to permit the seat to be reversed without the need for detaching the seat from the carriage.

Having thus described the invention in detail, it is to be understood that the foregoing description is not intended to limit the spirit and scope thereof. What is desired to be protected by Letters Patent is set forth in the appended claims.

What is claimed is:

1. An exercise apparatus comprising:

a single vertical guide rail;

support means for supporting the vertical guide rail;

a carriage for riding with the vertical guide rail;

a handle pivotally interconnected with the carriage and extending from a first side of the carriage for moving the carriage along the vertical guide rail, the handle including a grip, the grip positioned on the first side of the carriage;

means for locking the position of the handle at a desired angle with respect to the carriage; and weight support means positioned on the first side of the carriage for supporting weight on the carriage.

2. The apparatus of claim 1 wherein the weight support means supports free weight plates.

3. The apparatus of claim 2 wherein the weight support means comprises a cylindrical bar received by the carriage.

4. The apparatus of claim 3 wherein the cylindrical bar is received in apertures in the carriage.

5. The apparatus of claim 4 wherein the handle is angularly adjustable about the cylindrical bar with respect to the carriage.

6. The apparatus of claim 5 wherein the weight support means extends through apertures in the handle which correspond to the apertures in the carriage, and the handle pivots about the weight support means.

7. The apparatus of claim 5 further including rollers interconnected with the carriage for rolling the carriage along the vertical guide rail.

8. The apparatus of claim 5 further comprising a cushion removably attached to the handle for contacting a user's back and shoulders during squatting exercises.

9. An exercising apparatus comprising:

a single guide rail supported by a base, the guide rail having a forward side and back side;

a carriage having side plates extending about the guide rail;

rollers carded by the carriage, the rollers interconnected with the plates of the carriage and positioned about the guide rail for rolling the carriage along the guide rail;

a weight bar interconnected with the carriage for supporting free weight plates; and a handle extending from the weight bar, the handle pivotally interconnected with the weight bar, the handle lockable at a desired angle with respect to the weight bar to adjustably interconnect the handle with the carriage for moving the carriage along the guide rail.

10. The apparatus of claim 9 wherein the weight bar is received in weight bar apertures in the side plates of the carriage.

11. The apparatus of claim 10 wherein the weight bar apertures are positioned on the carriage on the forward side of the guide rail.

12. The apparatus of claim 11 wherein the handle includes weight bar apertures corresponding to the weight bar apertures in the side plates for receiving the weight bar therethrough.

13. An exercising apparatus comprising:

a guide rail supported by a base, the guide rail having a forward side and back side;

a carriage having side plates extending about the guide rail;

rollers carded by the carriage, the rollers interconnected with the plates of the carriage and positioned about the guide rail for rolling the carriage along the guide rail;

a weight bar interconnected with the carriage for supporting free weight plates, the weight bar received in weight bar apertures in the side plates of the carriage, the weight bar apertures positioned on the carriage on the forward side of the guide rail; and a handle adjustably interconnected with the carriage for moving the carriage along the guide rail, the handle extending from the carriage on the forward side of the guide rail, the handle including weight bar apertures corresponding to the weight bar apertures in the side plates for receiving the weight bar therethrough, the handle pivoting about the weight bar.

* * * * *